US006510300B2

(12) United States Patent
Mizoguchi et al.

(10) Patent No.: US 6,510,300 B2
(45) Date of Patent: Jan. 21, 2003

(54) TONER CARTRIDGE WITH MIXED TONER DELIVERY APPARATUS

(75) Inventors: Fumito Mizoguchi, Yamatokoriyama (JP); Hiroshi Kubota, Osaka (JP); Takeshi Wakabayashi, Kyoto (JP); Hisashi Kunihiro, Nara (JP); Takahiko Kimura, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/861,704

(22) Filed: May 22, 2001

(65) Prior Publication Data

US 2001/0043826 A1 Nov. 22, 2001

(30) Foreign Application Priority Data

May 22, 2000 (JP) ..... 2000-149978

(51) Int. Cl.[7] ..... G03G 15/08

(52) U.S. Cl. ..... 399/106; 399/120; 399/258; 399/263; 399/359

(58) Field of Search ..... 399/106, 120, 399/253, 258, 262, 263, 358, 359

(56) References Cited

U.S. PATENT DOCUMENTS 5,235,130 A 8/1993 Demoto et al.
5,307,128 A * 4/1994 Murasaki et al. ..... 399/359 X
6,041,212 A * 3/2000 Okada ..... 399/359
6,115,574 A * 9/2000 Mikuriya ..... 399/258

FOREIGN PATENT DOCUMENTS

| | | |
|---|---|---|
| JP | 5-80653 | 4/1993 |
| JP | 9-212055 | 8/1997 |
| JP | 9-251230 | 9/1997 |

* cited by examiner

*Primary Examiner*—William J. Royer
(74) *Attorney, Agent, or Firm*—Birch, Stewart, Kolasch & Birch, LLP

(57) ABSTRACT

A toner cartridge having toner agitating and mixing properties. The structure insures image quality without increasing in complexity of the structure as well as capable of being compacted. A used toner recycling opening for dropping used toner by gravity is formed in an upper wall of a cartridge main body storing fresh toner. A toner agitator and a toner supply device with an opening for supplying mixed toner to a developing apparatus are arranged within the cartridge main body. The toner can be sufficiently mixed and agitated on a cartridge main body side without depending on a developing apparatus side, and the toner cartridge is prevented from being large-sized. In particular, since the used toner drops by gravity, a taking-in structure of this used toner is simplified, and a mixing work of the used toner with fresh toner is made irrespective of a moving direction of the toner agitator. Also, there are two film sealing members for sealing the used toner recycling and toner supply openings.

9 Claims, 10 Drawing Sheets

TONER CARTRIDGE WITH MIXED TONER DELIVERY APPARATUS

BACKGROUND OF THE INVENTION

1. Field of the Invention

The present invention relates to a toner cartridge in relation to an image forming apparatus using an electrophotographic process such as a digital copying machine, a printer and a facsimile apparatus, and more particularly a toner cartridge detachably connected to a developing apparatus.

2. Description of the Related Art

In a generally-used image forming apparatus, for the purpose of simplifying an operation of replenishing toner, a toner cartridge which is filled with toner in advance and is detachably mounted to a developing apparatus, is used, and which toner cartridge can be replaced with a new one when all the toner stored in the toner cartridge is used up.

However, recycling of resources has been drawing more attention than ever. An increasing number of image forming apparatuses using an electrophotographic process have been equipped with a so-called toner recycling function in which left-over toner on a photoconductor drum after an image transfer process is removed by a cleaner and collected as used toner to be reused in the developing apparatus. By using such a function, it is possible to extend a replacement cycle of toner cartridges.

In a conventional image forming apparatus having the toner recycling function shown in FIG. 5, fresh toner is supplied from a toner cartridge 101 detachably mounted to a developing apparatus 100. Further, used toner in the developing apparatus 100 is collected in a process unit 102, and is released to a releasing portion 103 of the process unit 102. The used toner released at the releasing portion 103 is conveyed to the developing apparatus 100 through a conveying path 104.

Further, as shown in FIG. 6, there is another prior art providing a structure that a downstream end of a toner supplying path 105 extended from the toner cartridge 101, in which fresh toner passes through, is connected to a downstream end of a conveying path 104 extended from the process unit 102, so that the fresh toner is joined with the used toner and the joined toner is then supplied to the developing apparatus 100.

In the former prior art, the collected used toner is supplied to the developing apparatus 100 without any treatment. In this case, it is difficult to sufficiently mix the fresh toner with the used toner within the developing apparatus 100. In the latter prior art, the collected used toner and fresh toner are joined together to be supplied to the developing apparatus 100. However, in this case, too, the mixing process of the joined toners depends on an agitating operation within the developing apparatus 100. Accordingly, it is also not easy to obtain a preferable mixing state.

Japanese Unexamined Patent Publication JP-A 9-212055 (1997) discloses a construction for actively mixing both toners as shown in FIG. 7. In this construction, a toner mixer 106 is provided to mix the used toner t released from the process unit 102 with the fresh toner T supplied from a toner cartridge main body 101A. In this case, toners T, t mixed inside the toner mixer 106 are supplied to the developing apparatus 100.

However, in the construction of the above publicly known example, the toner mixer 106 is provided separately from the toner cartridge main body 101A so that an additional accommodation space must be created, and thus the entire structure becomes large. As such, it is not likely to willingly adopt such a construction.

In consideration of such a situation, Japanese Unexamined Patent Publication JP-A 9-251230 (1997) discloses a construction as shown in FIG. 8. In this construction, a used toner collecting port 110 is formed in a lower portion of a side wall 101*a* of the cartridge main body 101A, and a toner replenishing port 111 is formed in a bottom wall 101*b* of the cartridge main body 101A. A toner agitator 112 and a rotating body 113 for conveying toner are arranged within the cartridge main body 101A. The used toner t conveyed from the used toner collecting port 110 by a toner taking-in mechanism 114 is mixed with the fresh toner T by the toner agitator 112. The mixed toner is supplied to the developing apparatus 100 through the toner replenishing port 111 by the rotating body 113 to replenish the toner.

In the case of JP-A 9-251230, it may be possible to downsize the construction, however, the used toner collecting port 110 arranged in the lower portion of the side wall 101*a* of the cartridge main body 101A requires an additional structure of taking-in mechanism 114 in order to convey the used toner t in a horizontal direction from the used toner collecting port 110. Further, as a result of such a structure, it is also required to provide additional structures such as a sealing mechanism, resulting in complication of the entire structure. Further, since the used toner t is conveyed horizontally, there is such a problem that reliable agitating and mixing states cannot be obtained easily unless a moving direction of the toner agitator 112 and so on are adequately set.

Further, as shown in FIG. 9, Japanese Unexamined Patent Publication JP-A 5-80653 (1993) discloses a seal member 204 provided in a toner hopper 201, wherein one end of the seal member 204 blocks a toner supply port 202 and the other end thereof is secured to a rotary shaft 203*a* of an agitating member 203. When the invention is used, the seal member 204 is rolled up by rotating of the agitating member 203.

However, in the construction of JP-A 5-80653, the seal member 204 rolled up by the agitating member 203 is collected inside the toner hopper 201. In this case, there is a possibility that the sealing member is subject to sag or peel off during rotation of the agitating member 203, which will result in a deficiency in toner agitating and conveying properties.

SUMMARY OF THE INVENTION

An object of the invention is to solve the above problems and to provide a toner cartridge having excellent toner agitating and mixing properties. The toner cartridge results in improved image quality without increasing in complexity of the structure as well as being compact.

In order to solve the above-mentioned problem, the invention has the following construction.

The invention provides a toner cartridge detachably mounted to a developing apparatus, comprising:

a cartridge main body for containing toner, having a used toner recycling opening formed in an upper portion thereof via which conveyed used toner is dropped by gravity and is received into the cartridge main body, the toner cartridge being mounted to the developing apparatus in a state where the cartridge main body is filled with toner;

toner agitating means arranged within the cartridge main body, for agitating and mixing used toner and fresh toner; and toner supply means arranged within the cartridge main body, for supplying agitated toner to the developing apparatus via a toner supply opening formed in the cartridge main body.

According to the invention, the conveyed used toner drops by gravity into the cartridge main body from the used toner recycling opening in the upper portion of the cartridge main body. Accordingly, the fresh toner and the used toner are efficiently agitated and mixed by the toner agitating means arranged within the cartridge main body. The agitated and mixed toner is supplied to the developing apparatus through the toner supply opening by the toner supply means arranged within the cartridge main body. Thus, a sufficient toner mixing state is obtained on a toner cartridge side without entrusting the agitation and mixture of the toners onto a developing apparatus side.

According to the invention, the used toner drops by gravity from the used toner recycling opening in the upper portion of the cartridge main body storing the fresh toner. Further, the toner agitating means and the toner supply means for supplying the mixed toner to the developing apparatus are arranged within the cartridge main body. Thus, the toner can be sufficiently mixed and agitated on the cartridge main body side without entrusting the mixture and the agitation onto the developing apparatus side. Further, it is possible to prevent an image forming apparatus from being large-sized. In particular, since the used toner drops by gravity, its taking-in structure is simplified, and the used toner can be efficiently mixed with the fresh toner irrespective of a moving direction of the toner agitating means.

In the invention it is preferable that the toner cartridge has a first film sealing member separably joined to the cartridge main body, for sealing the used toner recycling opening, and a second film sealing member separably joined to the cartridge main body, for sealing the toner supply opening, and each of free ends of the first and second film sealing members extending from their respective joining ends to an unsealing operation position by turning-up is set to an unsealing operation end, and the unsealing operation ends of the first and second film sealing members may be connected to each other either as an integral piece or by a connecting member.

According to the invention, the unsealing operation ends of the first and second film sealing members are connected to each other as described, for example, above. Accordingly, when an unsealing operation, which is an operation of pulling the connected operation ends to remove the sealing members, is performed once in replacement of the toner cartridge, both the sealing members are simultaneously separated from the cartridge main body, and the used toner recycling opening and the toner supply opening are reliably opened. Namely, with this structure it is prevented that only one of the opening portions is still in a sealing state. Further, it is sufficient to connect both the film sealing members at their unsealing operation ends after both the opening portions are sealed by the separate film sealing members at their sealing ends. Accordingly, the work of sealing the openings is easily made.

According to the invention, the toner cartridge has the first film sealing member separably joined to the cartridge main body and sealing the used toner recycling opening, and the second film sealing member separably joined to the cartridge main body and sealing the toner supply opening, and free ends of the first and second film sealing members extending from their respective joining ends to unsealing operation positions by turning-up are respectively set to unsealing operation ends, and these unsealing operation ends are connected to each other. Accordingly, when one unsealing operation using tensile force is performed, both the sealing members are simultaneously separated from the cartridge main body, and it is possible to dissolve a fear that one of the used toner recycling opening and the toner supply opening is used in error in a sealing state. Further, it is sufficient to connect both the film sealing members after both the opening portions are sealed by the separate film sealing members. Accordingly, the work of sealing the opening portions can be easily made.

In the invention it is preferable that the unsealing operation ends of the first and second film sealing members are integrally constructed for example, as a continuous piece.

According to the invention, the unsealing operation ends of the first and second film sealing members are integrally formed. Accordingly, it is not necessary to connect both the unsealing operation ends so that a manufacturing process can be simplified.

According to the invention, since the unsealing operation ends of both the first and second film sealing members are integrally formed, it is possible to omit the work of connecting the unsealing operation ends of both the film sealing members so that the manufacturing process can be simplified.

In the invention it is preferable that a contact portion is formed in a connecting portion of the unsealing operation ends of the first and second film sealing members which contact portion contacts with a portion of an outer covering member of an image forming apparatus provided with the developing apparatus, in a state where the cartridge main body is mounted to the developing apparatus to inhibit closure of the outer covering member.

According to the invention, in the mounting state of the cartridge main body to the developing apparatus, the contact portion formed in the connecting portion of the unsealing operation ends of the first and second film sealing members unseparated from the cartridge main body contacts with one portion of the outer covering member of the image forming apparatus, and cannot close the outer covering member. Accordingly, it is necessary to separate the first and second film sealing members from the cartridge main body and remove the contact portion to close the outer covering member and perform an image forming operation of the image forming apparatus. Thus, no image forming operation is executed in a sealing state of each of the used toner recycling opening and the toner supply opening. Further, no worker forgets the work of separating the first and second film sealing members from the cartridge main body.

According to the invention, in the mounting state of the cartridge main body to the developing apparatus, the contact portion formed in the connecting portion of the unsealing operation ends of the first and second film sealing members unseparated from the cartridge main body contact with one portion of the outer covering member of the image forming apparatus, and cannot close the outer covering member. Accordingly, it is possible to prevent the image forming operation from being executed in the sealing state of each of the used toner recycling opening and the toner supply opening. Further, it is possible to reliably prevent a worker from forgetting the work of removing the first and second film sealing members from the cartridge main body.

In the invention it is preferable that the cartridge main body has a winding rotating body for separating the first and second film sealing members from the cartridge main body by winding the unsealing operation ends of the first and second film sealing members.

According to the invention, when the winding rotating body is rotated, both the film sealing members are wound together so that the used toner recycling opening and the toner supply opening are easily unsealed.

According to the invention, the cartridge main body has the winding rotating body for winding the respective unsealing operation ends of both the film sealing members together. Accordingly, both the film sealing members can be wound around the winding rotating body together by rotating the winding rotating body. Therefore, it is possible to reduce an unsealing labor of the used toner recycling opening and the toner supply opening.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1A:
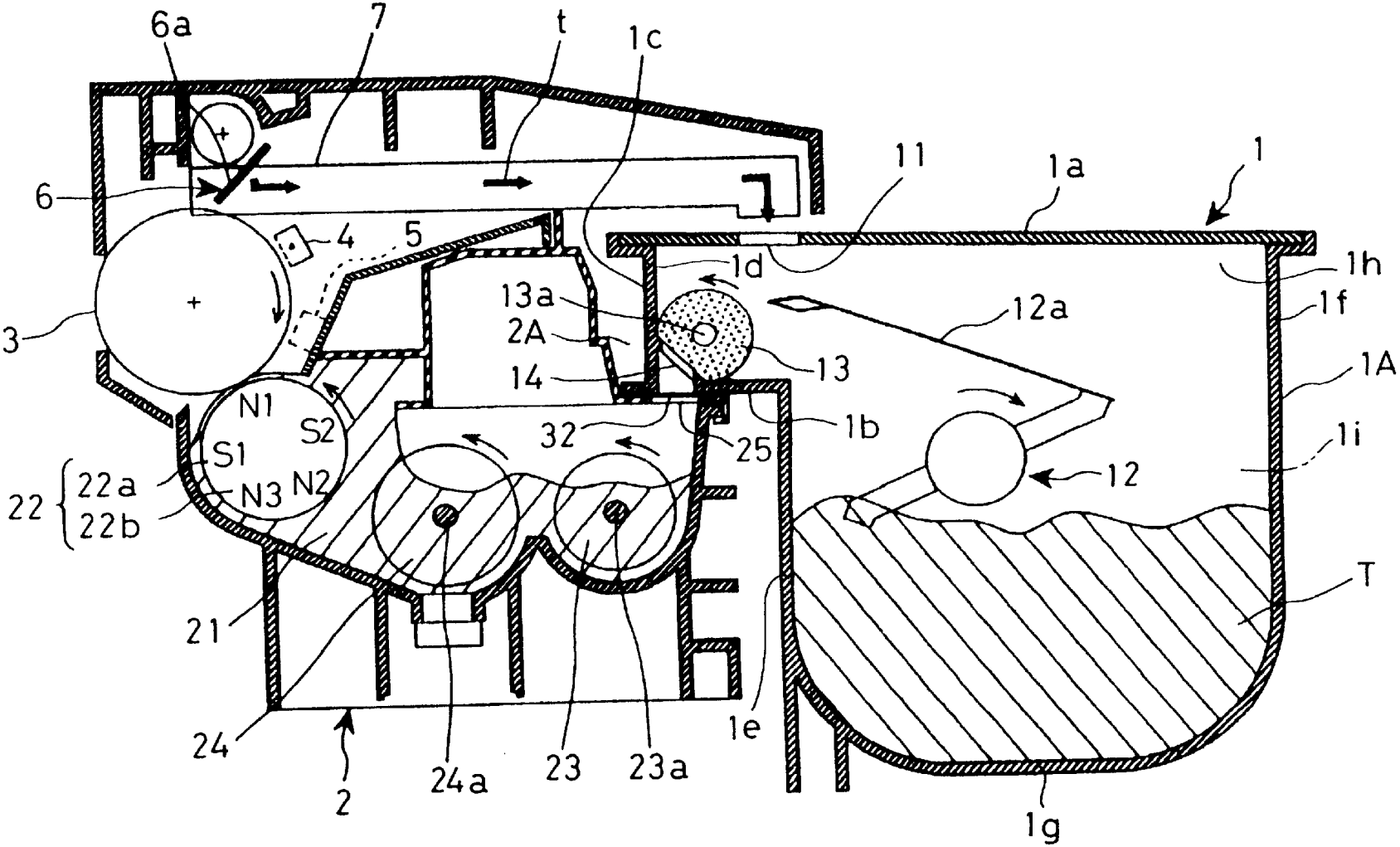
FIG. 1A is a cross-sectional view of an image forming apparatus including a toner cartridge of a first embodiment of the invention.

Now referring to the drawings, preferred embodiments of the invention are described below.

FIG. 1A is a cross-sectional view of an image forming apparatus including a toner cartridge of a first embodiment of the invention. This image forming apparatus includes a toner cartridge 1, a developing apparatus 2, a photoconductor drum 3 and so on. The toner cartridge 1 is detachably mounted with a projecting portion 1*c* of the toner cartridge 1 being fitted to a joint 2A formed on a side portion of the developing apparatus 2. The toner cartridge 1 includes a cartridge main body 1A, an agitating blade 12 and a toner replenishing roller 13.

A charger 4, an exposure device 5, a developing roller 22 of the developing apparatus 2, a transfer device (not shown) and a cleaner 6 are arranged in the order as mentioned, around the photoconductor drum 3 along its rotating direction.

A part of the surface of the photoconductor drum 3 is opposed to an opening face of the charger 4, and the entire surface of the photoconductor drum 3 is uniformly charged by discharge from the charger 4. The surface of the photoconductor drum 3 is subject to irradiation of light in accordance with printing information so that an electrostatic latent image is formed thereon in accordance with the applied electric charge pattern.

The developing apparatus 2 includes a developing portion housing 21, the developing roller 22 arranged in a position opposed to the photoconductor drum 3, a first agitating roller 23 and a second agitating roller 24. Respective rotating shafts 23*a*, 24*a* of the agitating rollers 23, 24 are supported with respect to the developing portion housing 21.

Toner supplied from the cartridge 1 and toner within the developing portion housing 21 are agitated by the first agitating roller 23, and the agitated toner is further agitated by the second agitating roller 24, and is then brought to the developing roller 22.

The developing roller 22 is provided with a plurality of magnetizing portions 22*a* polarized alternatively in a circumferential direction thereof, and a developing sleeve 22*b* having a magnetization and disposed on an outer circumferential side of the magnetizing portions. A predetermined developing bias voltage is applied to the developing sleeve 22*b*, and the developing sleeve 22*b* holds toner and carrier charged to polarities opposite to each other in an outer circumferential portion. The electrostatic latent image formed on the surface of the photoconductor drum 3 is developed with the toner brought thereon during contact with the developing roller 22 of the developing apparatus 2 as the roller rotates, and is visualized as a toner image. Next, the toner image formed on the photoconductor drum 3 is transferred to a surface of a transfer material by the transfer device (not shown), and is then fixed on the surface of the transfer material with a fixing device such as a heat roller. The cleaner 6 sweeps off the used toner t left on the surface of the photoconductor drum 3 with a blade 6*a* formed of urethane resin or the like, after the transfer process.

Between the cleaner 6 and the cartridge main body 1A, a toner collecting duct 7 is provided. The used toner t removed by the cleaner 6 is collected to the toner collecting duct 7, through which the used toner t is brought to the side of the cartridge main body 1A by a rotatable conveying blade provided therein.

The cartridge main body 1A stores fresh toner T and the used toner t, and includes a top wall portion 1*a*, the projecting portion 1*c*, a developing apparatus side wall portion 1*e*, an opposite side wall portion 1*f*, a bottom wall portion 1*g* and a pair of side wall portions 1*h*, 1*i*. The top wall portion 1*a* is placed as a top portion of the cartridge main body 1A. The developing apparatus side wall portion 1*e* is placed on the side closer to the developing apparatus 2 as a lower portion of the cartridge main body 1A.

The projecting portion 1*c* is located near the upper portion of the cartridge main body 1A, and includes a wall portion 1*b* and a projecting side wall portion 1*d*. The wall portion 1*b* is projected outward from the developing apparatus side wall portion 1*e*. The projecting side wall portion 1*d* is arranged between the edges of the top wall portion 1*a* and the wall portion 1*b*. As shown in FIG. 1A, the projecting portion 1*c* is projected outward from the developing apparatus side wall portion 1*e*, and is fitted and supported to the joint 2A of the developing apparatus 2.

The opposite side wall portion 1*f* is placed opposite to the projecting side wall portion 1*d* and the developing apparatus side wall portion 1*e*. The bottom wall portion 1*g* extends to the developing apparatus side wall portion 1*e* and the opposite side wall portion 1*f*, defining a bottom portion of the cartridge main body 1A. The pair of side wall portions 1*h*, 1*i* are placed to connect the edges of the respective side wall portions 1*b*, 1*d* to 1*g* (edges are located in a direction perpendicular to a paper face on FIG. 1A). The top wall portion 1*a* is provided to connect the upper portions of the side wall portions 1*d*, 1*f*, 1*h*, 1*i*. Thus, an internal space of the cartridge main body 1A is defined by these respective wall portions 1*a*, 1*b*, 1*d* to 1*i*.

A used toner recycling opening 11 is formed in the upper wall 1*a* of the cartridge main body 1A in order to let the used toner t pass through from the toner collecting duct 7 towards the cartridge main body 1A by gravity. Further, a toner supply opening 14 is formed in the wall portion 1*b* of the projecting portion 1*c* in accordance with the location of a toner receiving hole 25 on a side of the developing apparatus 2. The toner supply opening 14 is formed as a long slit shape extending along the axial direction of the toner replenishing roller 13 described later.

The agitating blade 12 is located inside the cartridge main body 1A approximately at its center, and is provided as agitating means for agitating and mixing the fresh toner T and the used toner t. The agitating blade 12 is provided with a flexible scoop piece 12*a*, extending in a direction opposite to a rotating direction (a direction opposite to an arrow in FIG. 1A) of the agitating blade 12. The flexible scoop piece 12*a* scoops up the fresh toner T being agitated towards a toner replenishing roller 13 described below. A toner replenishing means, for example the toner replenishing roller 13, is provided within the cartridge main body 1A. A rotating shaft 13*a* of this toner replenishing roller 13 is rotatably supported by side wall portions 1*h*, 1*i* of the cartridge main body 1A. The toner replenishing roller 13 is formed of a porous elastic body such as a urethane sponge so that the toner replenishing roller 13 can be rotated in close contact with an inner face of the cartridge main body 1A.

The toner replenishing roller 13 drops mixed toner of fresh toner T and used toner t towards the position close to the first agitating roller 23 through the toner supply opening 14 when the toner replenishing roller 13 receives a toner replenishing signal generated in accordance with a toner density detecting signal from a toner sensor (not shown) provided inside the developing apparatus 2.

When the toner cartridge 1 is used, the used toner t falls into the cartridge main body 1A by gravity through the used toner recycling opening 11, and is agitated and mixed with the fresh toner T by the agitating blade 12. The agitated and mixed toners T, t are scooped upward by rotation movement of the scoop piece 12*a* of the agitating blade 12 to the position of the toner replenishing roller 13. Then, the mixed toner is replenished from the toner supply opening 14 to the developing apparatus 2 as the toner replenishing roller 13 rotates.

The physical relationship between the toner replenishing roller 13 and the used toner recycling opening 11 may be set as desired, and the toner replenishing roller 13 may also be positioned near the used toner recycling opening 11. In this case, it is also possible to mix the used toner t dropping by gravity with the fresh toner T scooped up at the toner replenishing roller 13.

Further, the fresh toner T and the used toner t are mixed together inside the cartridge main body 1A and then supplied to the developing apparatus 2. Accordingly, the fresh toner T and the used toner t are well-mixed compared to the case where the mixing and agitation operations of the fresh toner T and the used toner t are performed at the developing apparatus 2. Therefore, burden on the developing apparatus 2 can be reduced, and a stable image quality can be obtained.

The agitating blade 12 as a mixing portion for mixing and agitating the used toner t and the fresh toner T, and the toner replenishing roller 13 as a toner supply portion are arranged inside the cartridge main body 1A. Accordingly, the toner cartridge is easily made compact in comparison with the case where the mixing portion is mounted outside the cartridge main body 1A.

In particular, the used toner recycling opening 11 is formed in the upper wall 1*a* of the cartridge main body 1A, and the used toner t is dropped by gravity. Accordingly, it is possible to perform preferable agitating and mixing operations irrespective of a rotating direction of the agitating blade 12. Further, a taking-in mechanism and special blocking structure which performs forced conveying of the used toner t from a lower side of the cartridge main body 1A to the interior, are not required, thereby making a simplified structure possible.

Figure 1B:
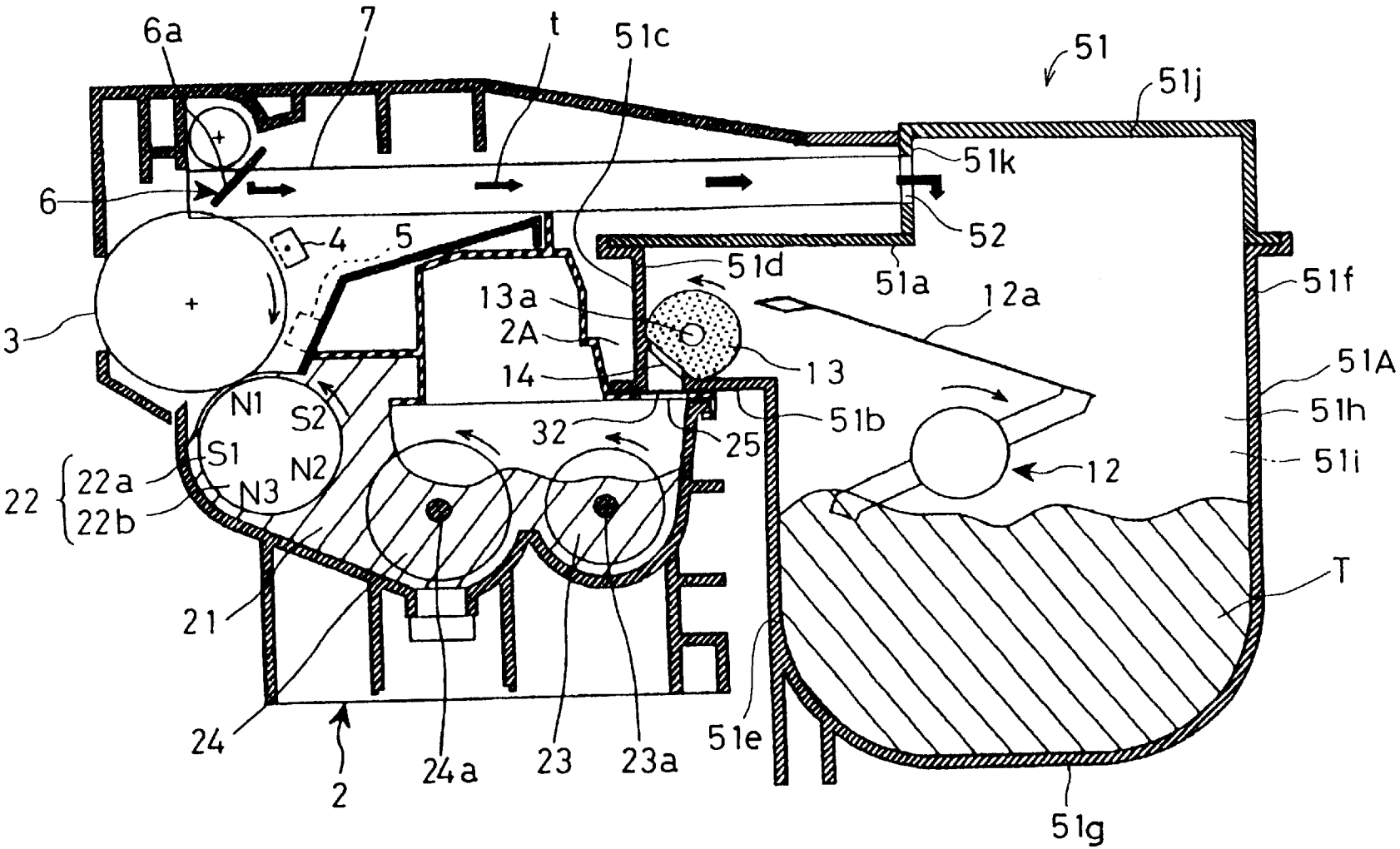
FIG. 1B is a cross-sectional view of an image forming apparatus to which a toner cartridge of a second embodiment of the invention is applied.

FIG. 1B is a cross-sectional view of an image forming apparatus to which a toner cartridge of a second embodiment of the invention is applied. In the second embodiment, parts corresponding to those in the first embodiment are given the same reference numerals, accordingly repetition of the same explanation is avoided. The toner cartridge 51 shown in FIG. 1B has a construction similar to the toner cartridge 1 shown in FIG. 1A. However, in the second embodiment, the used toner t is brought to a toner cartridge main body 51A through an opening provided to an upper side portion of the closer side to the developing apparatus 2 of the toner cartridge 51.

The toner cartridge 51 includes the toner cartridge main body 51A, an agitating blade 12 and a toner replenishing roller 13. The toner cartridge main body 51A stores the fresh toner T and the used toner t, and includes a wall portion 51*b*, a projecting portion 51*c*, a projecting side wall portion 51*d*, a developing apparatus side wall portion 51*e*, an opposite side wall portion 51*f*, a bottom wall portion 51*g* and a pair of side wall portions 51*h*, 51*i* which are respectively similar in construction to the wall portion 1*b*, the projecting portion 1*c* the projecting side wall portion 1*d*, the developing apparatus side wall portion 1*e*, the opposite side wall portion 1*f*, the bottom wall portion 1*g* and the pair of side wall portions 1*h*, 1*i* in the toner cartridge 1. Further, the toner cartridge main body 51A includes a first top wall portion 51*a*, a second top wall portion 51*j* and an upper side wall portion 51*k* in an upper portion of the toner cartridge main body 51A. The wall portions 51*a*, 51*j*, 51*k* close upper portions of the respective side wall portions 51*d*, 51*f*, 51*h*, 51*i*.

The first top wall portion 51*a* is placed in an area of the upper portion of the toner cartridge main body 51A on a side closer to the developing apparatus 2. The second top wall portion 51*j* is placed in a relatively outward position from a position of the first top wall portion 51*a* and an area of an upper portion of the toner cartridge main body 51A on a side farther from the developing apparatus 2 compared to the first top wall portion 51*a*. The upper side wall portion 51*k* is placed between the first top wall portion 51*a* and the second top wall portion 51*j* so as to bypass an edge of the first top wall portion 51*a* on a side farther from the developing apparatus 2 and an edge of the second top wall portion 51*j* on a side closer to the developing apparatus 2.

A used toner recycling opening 52 for dropping the used toner t by gravity from the toner collecting duct 7 into the cartridge main body 51A is formed in the upper side wall portion 51*k*. Similar to the toner cartridge 1 in the first embodiment, an agitating blade 12 and a toner replenishing roller 13 are provided inside the cartridge main body 51A.

Effects similar to those in the second embodiment are also obtained in such a construction.

Figure 1C:
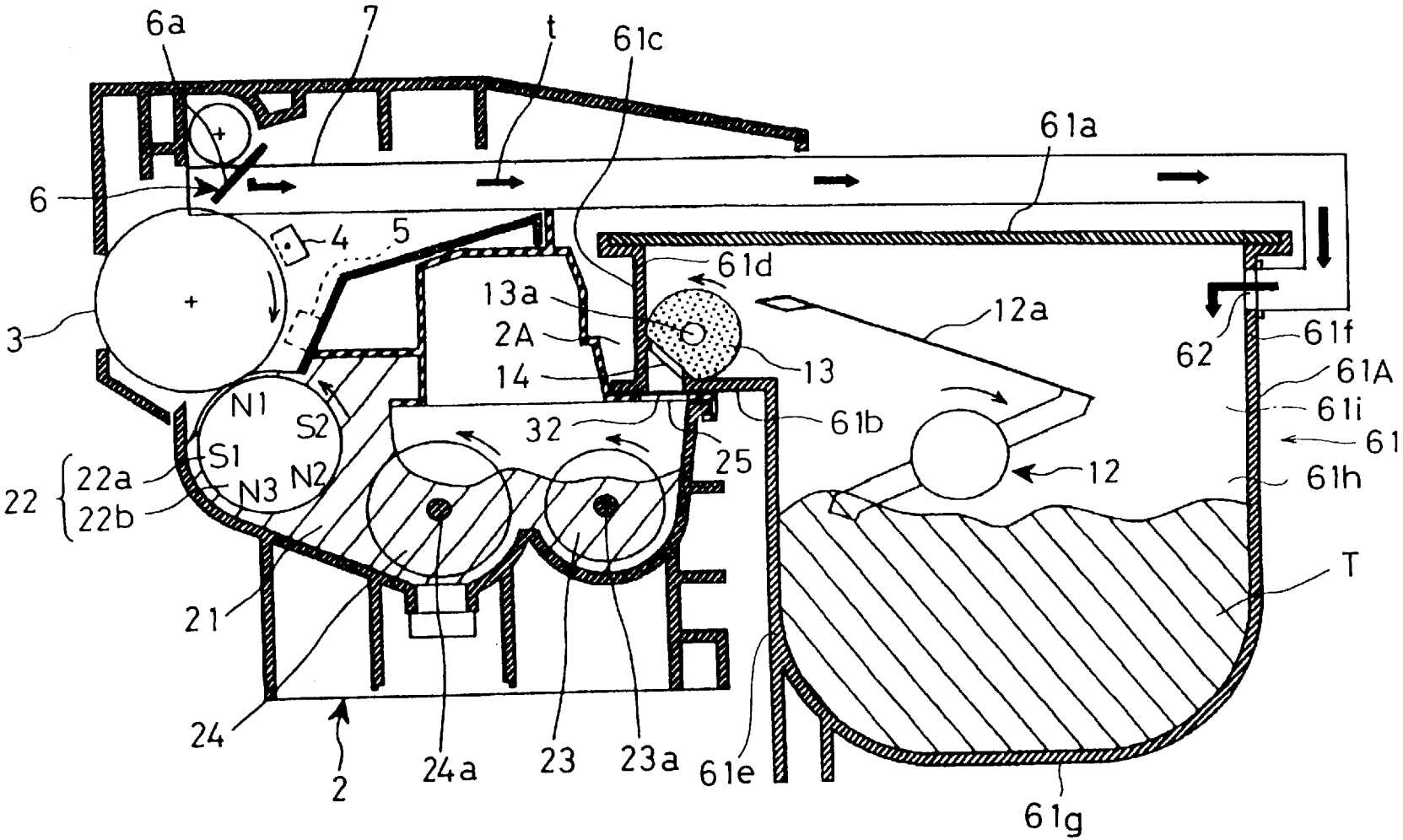
FIG. 1C is a cross-sectional view of an image forming apparatus to which a toner cartridge of a third embodiment of the invention is applied.

FIG. 1C is a cross-sectional view of an image forming apparatus to which a toner cartridge of a third embodiment of the invention is applied. In the third embodiment, parts corresponding to those in the above embodiments are given the same reference numerals, where repetition of the same explanation is avoided. The toner cartridge 61 shown in FIG. 1C has a construction similar to the toner cartridges 1, 51 shown in FIGS. 1A and 1B, and it should be noticed that the used toner t is supplied into a toner cartridge main body 61A from a side opposed to a side of the developing apparatus 2 on an upper portion side of the toner cartridge 61.

The toner cartridge 61 includes the toner cartridge main body 61A, an agitating blade 12 and a toner replenishing roller 13. The toner cartridge main body 61A stores the fresh toner T and the used toner t, and includes a wall portion 61*b*, a projecting portion 61*c* a projecting side wall portion 61*d*, a developing apparatus side wall portion 61*e*, an opposite side wall portion 61*f*, a bottom wall portion 61*g* and a pair of side wall portions 61*h*, 61*i* which are respectively similar in construction to the wall portions 1*b*;51*b*,the projecting portion 1*c*;51*c* the projecting side wall portions 1*d*;51*d*, the developing apparatus side wall portions 1*e*;51*e*, the opposite side wall portions 1*f*;51*f*, the bottom wall portions 1*g*;51*g*, and the pair of side wall portions 1*h*, 1*i*;51*h*, 51*i* in the toner cartridges 1;51. Further, the toner cartridge main body 61A includes a top wall portion 61*a* for closing upper portions of the respective side wall portions 61*d*, 61*f*, 61*h*, 61*i*.

A used toner recycling opening 62 for dropping the used toner t by gravity from the toner collecting duct 7 into the cartridge main body 61A is formed in an upper portion of the opposite side wall portion 61*f* opposed to the projecting side wall portion 61*d* and the developing apparatus side wall portion 61*e*. Similar to the toner cartridges 1, 51 in the first and second embodiments, the agitating blade 12 and the toner replenishing roller 13 are provided inside the cartridge main body 61A.

Effects similar to those in the first and second embodiments are also obtained in such a construction.

In addition, the used toner recycling opening 62 is provided at a position considerably distant from the toner supply opening 14, and thus the used toner t is not carried to the developing apparatus 2 through the toner supply opening 14 before being well-mixed with the fresh toner T. In this manner, a premature supply of the used toner t to the developing apparatus 2 is prevented.

Figure 2:
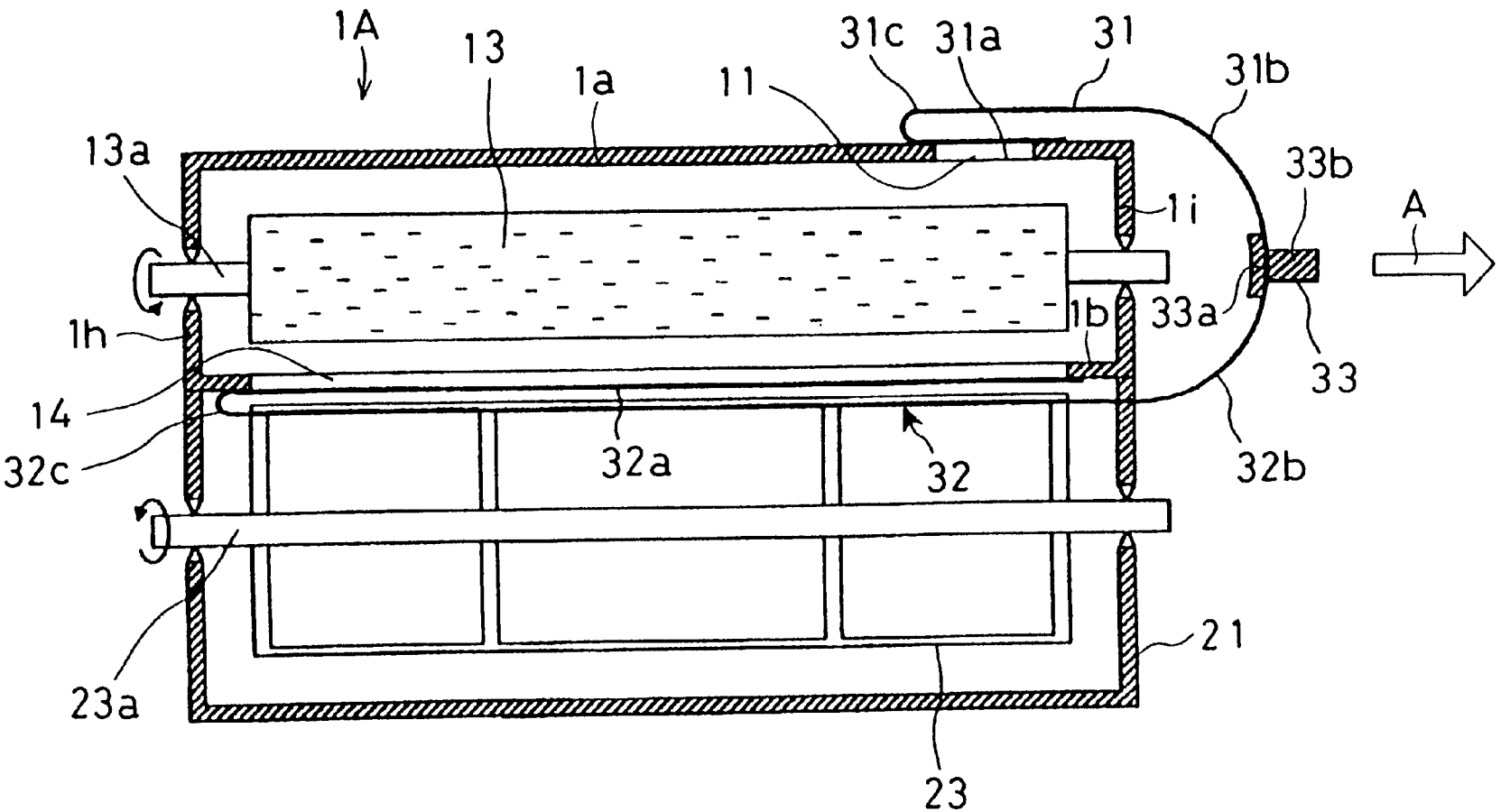
FIG. 2 is a cross-sectional view of a sealing structure with respect to the opening portions of the toner cartridge of the first embodiment of the invention, in a state where the toner cartridge is mounted to the developing apparatus.

FIG. 2 is a cross-sectional view of a sealing structure with respect to the openings 11, 14 of the toner cartridge 1 of the first embodiment of the invention in a state where the toner cartridge 1 is mounted to the developing apparatus 2. In FIG. 2, a film first sealing member 31 is removably attached to the cartridge main body 1A so as to seal the used toner recycling opening 11. A second film sealing member 32 is removably attached to the cartridge main body 1A so as to seal the toner supply opening 14.

One end 31*a* of the film first sealing member 31, which serves as a sealing end, is removably attached around the used toner recycling opening 11 on the outer surface of the cartridge main body 1A by means of heat melting attachment or an adhesive or the like. The film first sealing member 31 is turned around for 180° at a turning position 31*c* such that the other end 31*b* as an unsealing operation end, which is defined as an operation end in removing the first sealing member 31 from the cartridge main body 1A by pulling, is placed in an unsealing operation position with respect to the cartridge main body 1A.

Similarly, one end 32*a* of the second film sealing member 32, which serves as a sealing end, is removably attached around the toner supply opening 14 on the outer surface of the portion 1*b* of the cartridge main body 1A by means of heat melting attachment or an adhesive or the like. The second film sealing member 32 is turned around for 180° at turning position 32*c* in a direction parallel to a rotating shaft 13*a* of the toner replenishing roller 13, such that the other end 32*b* as an unsealing operation end, which is defined as an operation end in removing the second sealing member 32 from the cartridge main body 1A by pulling, is placed in the unsealing operation position on the side of the cartridge main body 1A. The unsealing operation ends 31*b*, 32*b* of both the film sealing members 31, 32 may be directly connected to each other or via a connecting member 33 as shown in the embodiment.

When the toner cartridge 1 is used in such a construction, the toner cartridge 1 is joined to the developing apparatus 2 at a predetermined portion. In this state, the unsealing operation is performed by pulling the connecting member 33 for connecting the respective unsealing operation ends 31*b*, 32*b* of the film sealing members 31, 32 in a direction of an arrow A of FIG. 2, so that the respective sealing ends 31*a*, 32*a* of the film sealing members 31, 32 are removed from the attached position on the outer surface of the cartridge main body 1A, and the used toner recycling opening 11 and the toner supply opening 14 are opened.

Figure 3A:
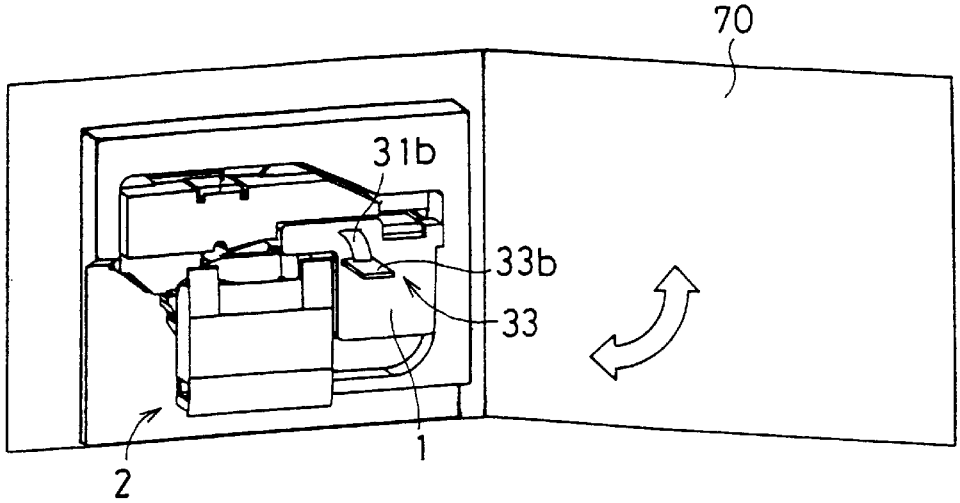
FIG. 3A is a perspective view showing arrangement of a part of an image forming apparatus to which a toner cartridge of the invention is mounted.
Figure 3B:
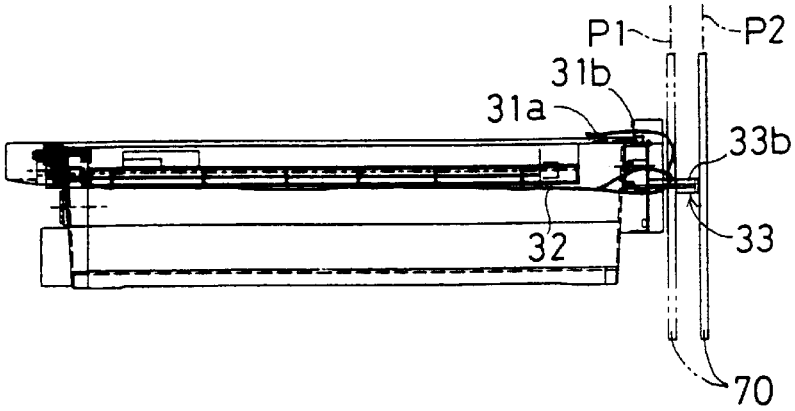
FIG. 3B is a view showing a physical relationship between a connecting part and an outer covering member.
Figure 3C:
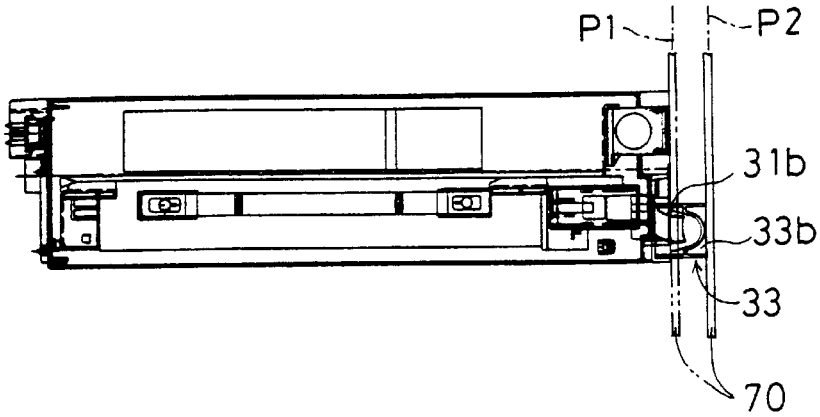
FIG. 3C is a plan view with respect to the members in FIG. 3B.

FIG. 3A is a perspective view showing arrangement of a part of the image forming apparatus, FIG. 3B is a view showing a physical relationship between a connecting part and an outer covering member, and FIG. 3C is a plan view with respect to the members in FIG. 3B. The connecting member 33 includes a connecting portion 33*a* for connecting the respective sealing ends 31*a*, 32*a* of the film sealing members 31, 32 and the connecting member 33 projected from the connecting portion 33*a* toward an outer covering member 70 of the image forming apparatus on the operation side thereof. That is, the outer covering member 70 of the image forming apparatus on its operation side is provided so as to be freely opened and closed. In order to mount the cartridge main body 1A to the developing apparatus 2, the outer covering member 70 of the image forming apparatus on its operation side is opened, and then the developing apparatus 2 is exposed to the operation side of the image forming apparatus as shown in FIG. 3A. Thereafter, the cartridge main body 1A is mounted to the developing apparatus 2, and the film sealing members 31, 32 are unsealed to remove. Thereby, the outer covering member 70 can be placed at the closed position P1 as shown in FIGS. 3B and 3C. Thereafter, the image forming apparatus becomes a state where an image forming operation can be performed when the outer covering member 70 on the operation side is closed. In the case where the outer covering member 70 of the image forming apparatus on its operation side is attempted to close without removing the film sealing members 31, 32 from the cartridge main body 1A mounted to the developing apparatus 2, the contact portion 33*b* of the connecting member 33 comes into contact with a part of the outer covering member 70 as shown in FIGS. 3B and 3C, whereby the outer covering member 70 is placed at the position P2 in order not to be closed.

When the toner cartridge 1 is used in a state where the used toner recycling opening 11 is sealed, there will be a possibility of problems such that the used toner t from the cleaner 6 is clogged within the collecting duct 7, resulting in malfunction of replenishing operation. Further, when the toner cartridge 1 is used in a state where the toner supply opening. 14 is sealed, toner will not be adequately supplied even if toner density within the developing apparatus 2 is in decline. Accordingly, there will be such a problem that no image can be formed.

On the other hand, in the case where the film sealing members 31, 32 are directly connected to each other at the respective unsealing operation ends 31*b*, 32*b* as mentioned above, and are not separated and removed in the toner cartridge 1 mounted to the developing apparatus 2, the contact portion 33*b* of the connecting member 33 comes into contact with one portion of the outer covering member 70, whereby the outer covering member 70 cannot be tightly closed. Therefore, the outer covering member 70 on the operation side of the image forming apparatus cannot be closed unless the film sealing members 31, 32 are removed together with the connecting member 33 from the cartridge main body 1A mounted to the developing apparatus 2. Accordingly, no image forming operation can be started in this state. Thus, it is possible to reliably prevent a user from operating without removing the film sealing members 31, 32 from the cartridge main body 1A. Accordingly, when an image forming operation is started, the used toner recycling opening 11 and the toner supply opening 14 can reliably be opened. Therefore, there will not be such a problem that malfunction of replenishing operation of the used toner t or absence of a formed image occurs.

The film sealing members 31, 32 are provided with the turning positions 31*c*, 32*c* respectively. As such, when both of the unsealing operation ends 31*b*, 32*b* are pulled out in the direction of the arrow A, outward separating force on the basis of tensile force is applied to the sealing ends 31*a*, 32*a* so that the sealing ends 31*a*, 32*a* can easily be removed.

Further, in the case where sealing processes on the used toner recycling opening 11 and the toner supply opening 14 are performed before a connecting process with respect to the unsealing operation ends 31*b*, 32*b* of both the film sealing members 31, 32, both of the film sealing members 31, 32 will not be entangled during the sealing process for the openings 11, 14, thereby realizing an efficient production process.

Further, the unsealing operation ends 31*b*, 32*b* of both the film sealing members 31, 32 may be continuously formed as a single sealing member. In this case, a process of connecting both the unsealing operation ends 31*b*, 32*b* after sealing can be omitted.

Figure 4:
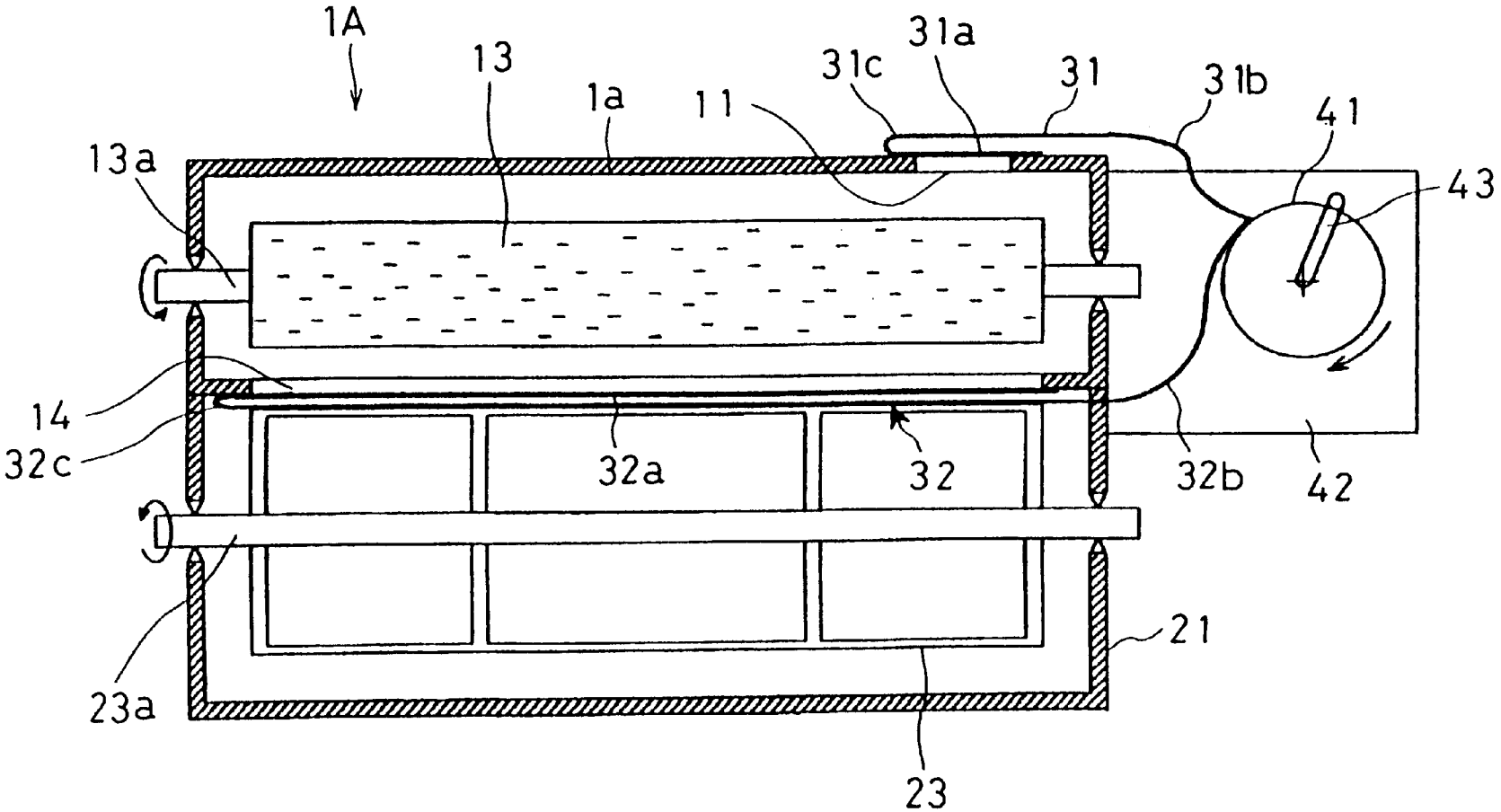
FIG. 4 is a cross-sectional view showing another example of the sealing members.
Figure 5:
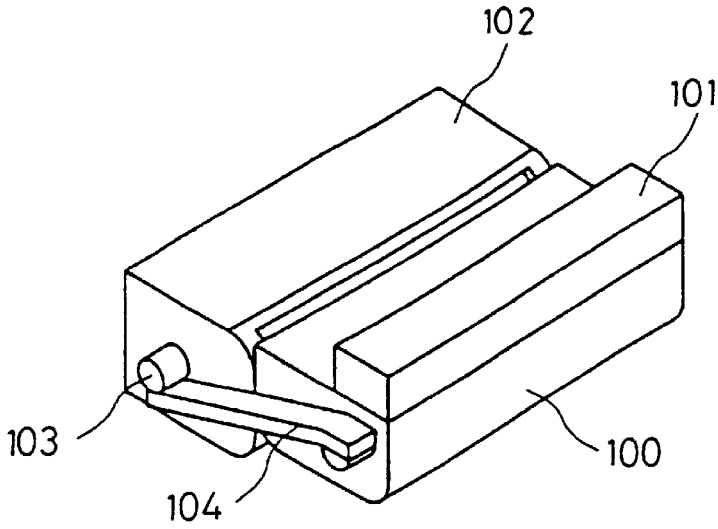
FIG. 5 PRIOR ART
FIG. 5 is a perspective view showing a used toner collecting structure of a conventional image forming apparatus.
Figure 6:
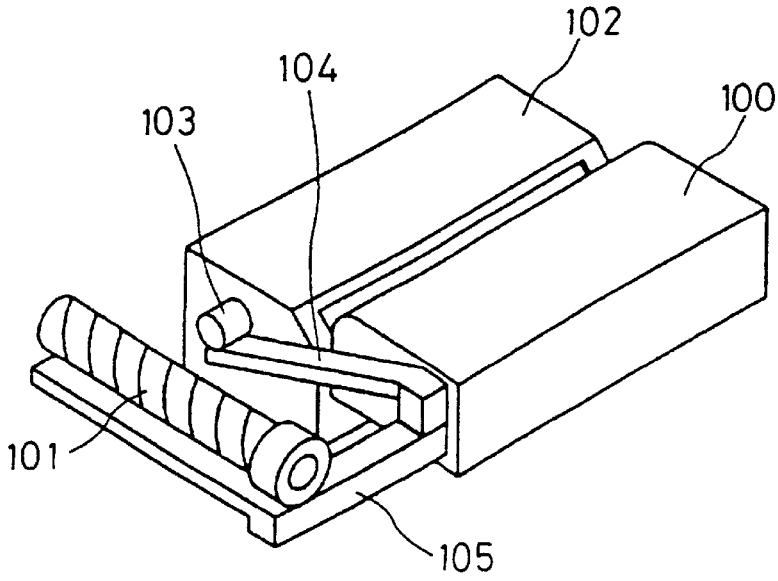
FIG. 6 PRIOR ART
FIG. 6 is a perspective view showing another used toner collecting structure in a conventional image forming apparatus.
Figure 7:
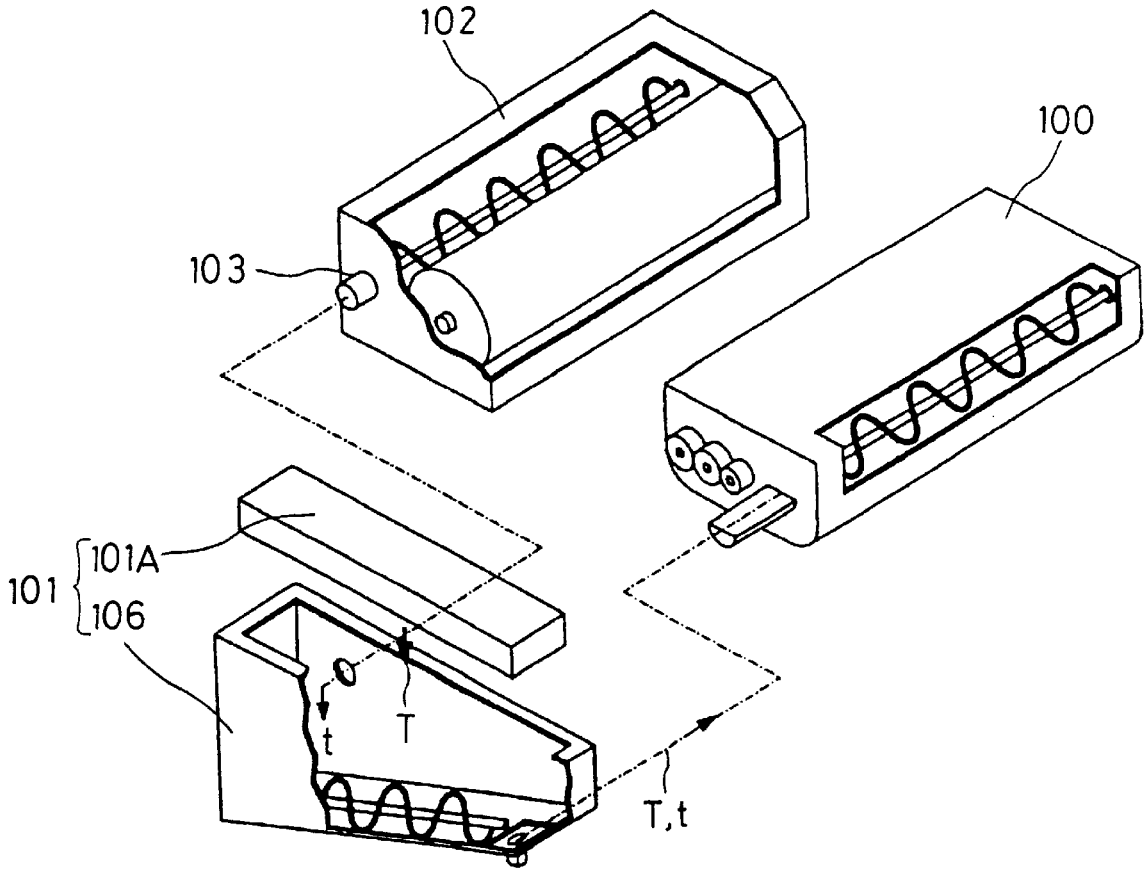
FIG.7 PRIOR ART
FIG. 7 is a perspective view showing still another used toner collecting structure in a conventional image forming apparatus.
Figure 8:
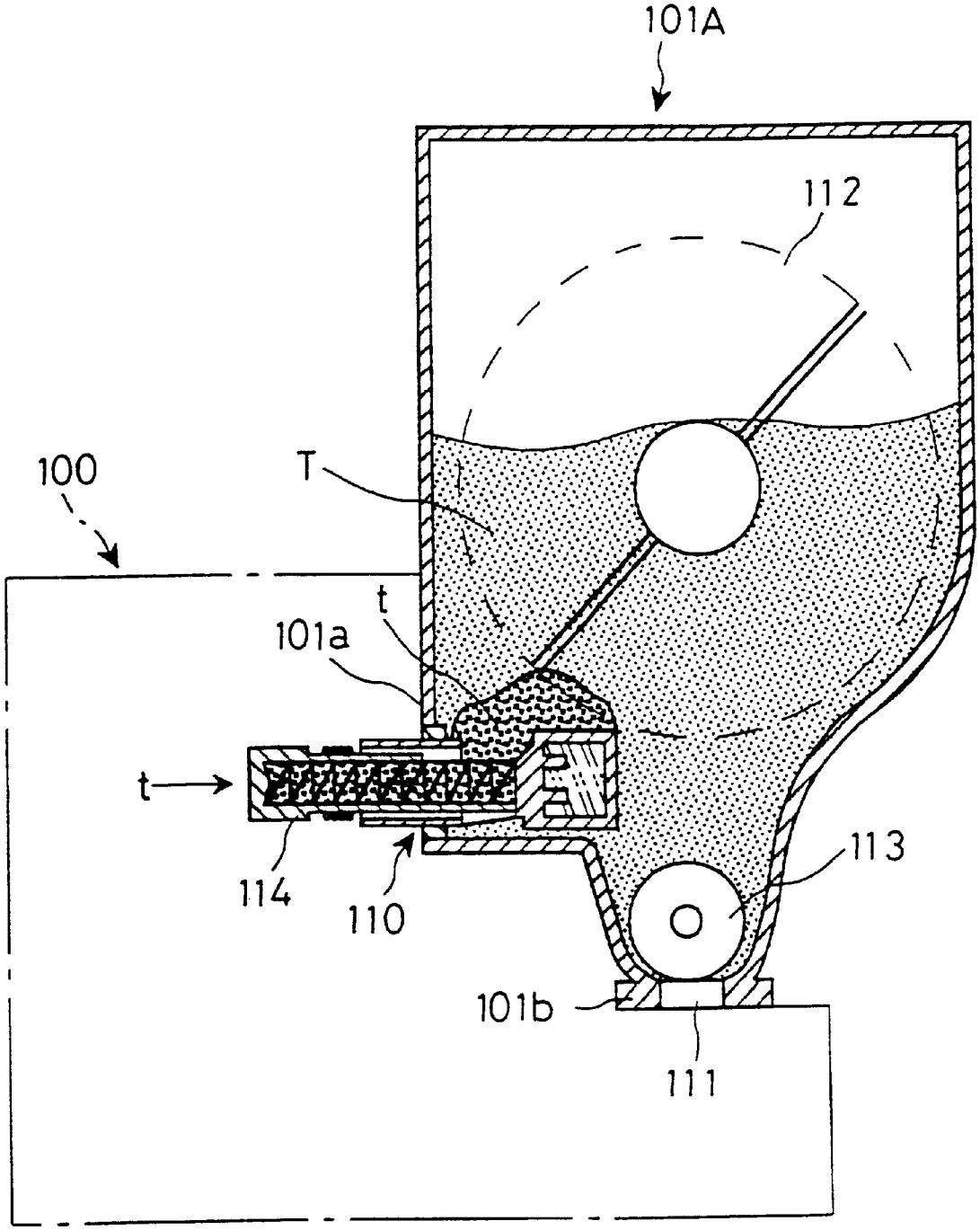
FIG.8 PRIOR ART
FIG. 8 is a cross-sectional view showing a toner cartridge having conventional collecting and mixing functions of used toner.
Figure 9:
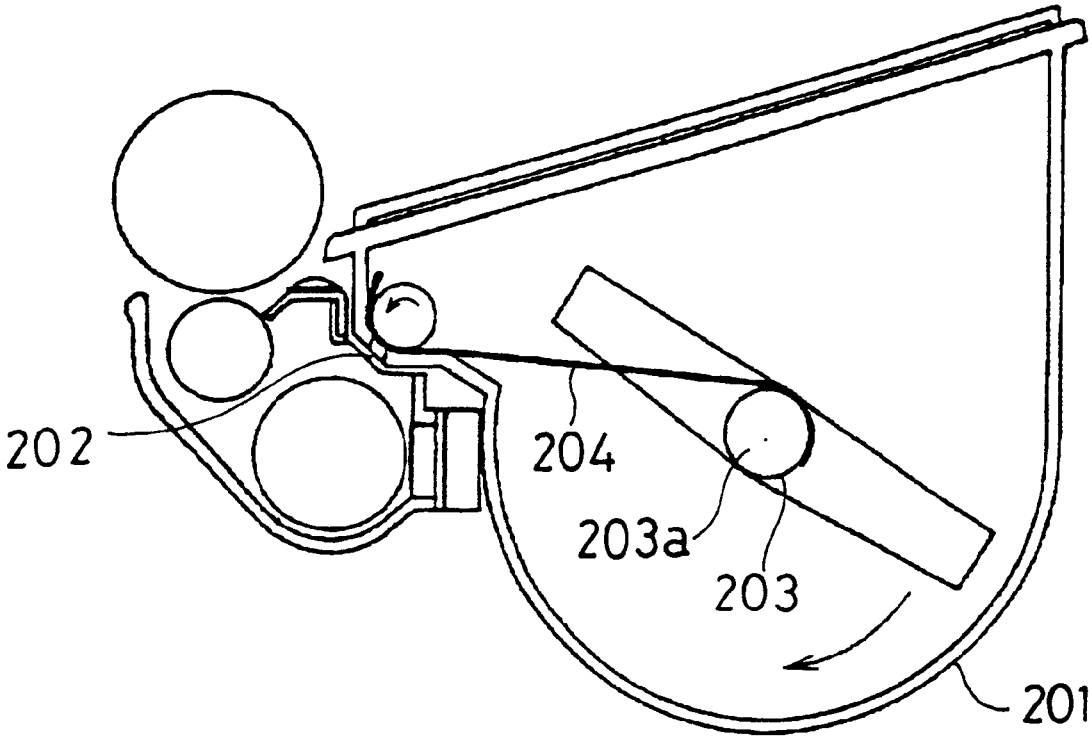
FIG. 9 PRIOR ART
FIG. 9 is a cross sectional view showing a toner cartridge having a conventional sealing member collecting mechanism.

FIG. 4 shows a spool 41 for winding the respective unsealing operation ends 31*b*, 32*b* of the film sealing members 31, 32, being rotatably supported at a predetermined position of the cartridge main body 1A, such as in a bracket 42 projected on a side face of the cartridge main body 1A.

In this construction, both the film sealing members 31, 32 are wound around the spool 41 arranged outside the cartridge main body 1A by rotating the spool 41 by a handle 43 or the like. Accordingly, the unsealing operation by means of removing the film sealing members 31, 32 can easily be made. Therefore, it is possible to prevent the sealing members 31, 32 from causing a negative impact on toner mixing or conveying performance inside the toner cartridge 1.

The sealing member positions shown in FIG. 2 and the winding construction of the sealing members shown in FIG. 4 can also be applied to the toner cartridges 51A, 61A shown in FIGS. 1B and 1C. Similar effects using these constructions are obtained.

The invention may be embodied in other specific forms without departing from the spirit or essential characteristics thereof. The embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner cartridge detachably mounted to a developing apparatus, comprising:

a cartridge main body for containing toner, having a used toner recycling opening formed in an upper portion thereof via which conveyed used toner is dropped by gravity and is received into the cartridge main body, the toner cartridge being mounted to the developing apparatus in a state where the cartridge main body is filled with fresh toner;

agitating means located within the cartridge main body, for agitating and mixing used toner and fresh toner; and a flexible scoop member for scooping up the used and fresh toner agitated by the agitating means located within the cartridge main body, for supplying agitated toner to the developing apparatus via a toner supply opening formed in the cartridge main body.

2. A toner cartridge detachably mounted to a developing apparatus, comprising:

a cartridge main body for containing toner, having a used toner recycling opening formed in an upper portion thereof via which conveyed used toner is dropped by gravity and is received into the cartridge main body, the toner cartridge being mounted to the developing apparatus in a state where the cartridge main body is filled with fresh toner;

toner agitating means arranged within the cartridge main body, for agitating and mixing used toner and fresh toner;

toner supply means arranged within the cartridge main body, for supplying agitated toner to the developing apparatus via a toner supply opening formed in the cartridge main body, a first film sealing member separably joined to the cartridge main body, for sealing the used toner recycling opening; and a second film sealing member separably joined to the cartridge main body, for sealing the toner supply opening, wherein free ends of the first and second film sealing members extending from their respective joining ends to an unsealing operation position by turning-up are set to unsealing operation ends, which are connected to each other.

3. The toner cartridge of claim 2, wherein the unsealing operation ends of the first and second film sealing members are integrally constructed continuously.

4. The toner cartridge of claim 3, wherein a contact portion is formed in a connecting portion of the unsealing operation ends of the first and second film sealing members which contact portion contacts with a portion of an outer covering member of an image forming apparatus provided with the developing apparatus, in a state where the cartridge main body is mounted to the developing apparatus to inhibit closure of the outer covering member.

5. The toner cartridge of claim 4, wherein the cartridge main body has a winding rotating body for separating the first and second film sealing members from the cartridge main body by winding the unsealing operation ends of the first and second film sealing members.

6. The toner cartridge of claim 3, wherein the cartridge main body has a winding rotating body for separating the first and second film sealing members from the cartridge main body by winding the unsealing operation ends of the first and second film sealing members.

7. The toner cartridge of claim 2, wherein a contact portion is formed in a connecting portion of the unsealing operation ends of the first and second film sealing members which contact portion contacts with a portion of an outer covering member of an image forming apparatus provided with the developing apparatus, in a state where the cartridge main body is mounted to the developing apparatus to inhibit closure of the outer covering member.

8. The toner cartridge of claim 7, wherein the cartridge main body has a winding rotating body for separating the first and second film sealing members from the cartridge main body by winding the unsealing operation ends of the first and second film sealing members.

9. The toner cartridge of claim 2, wherein the cartridge main body has a winding rotating body for separating the first and second film sealing members from the cartridge main body by winding the unsealing operation ends of the first and second film sealing members.

* * * * *